United States Patent [19]

Frink et al.

[11] Patent Number: 4,517,625

[45] Date of Patent: May 14, 1985

[54] CIRCUIT BOARD HOUSING WITH ZERO INSERTION FORCE CONNECTOR

[75] Inventors: Attila Frink, Northridge; Robert A. Morrison, Long Beach, both of Calif.

[73] Assignee: Lockheed Corporation, Burbank, Calif.

[21] Appl. No.: 549,941

[22] Filed: Nov. 9, 1983

[51] Int. Cl.[3] ..... H01R 9/09

[52] U.S. Cl. ..... 361/399; 339/74 R; 339/176 MP; 361/413; 361/415

[58] Field of Search ..... 361/415, 413, 398, 399; 211/41; 339/17 LM, 17 M, 74 R, 176 MP

[56] References Cited

U.S. PATENT DOCUMENTS

| | | | |
|---|---|---|---|
| 3,264,525 | 8/1966 | Swengel et al. | 339/17 LM X |
| 3,476,983 | 11/1969 | Robertis | 361/415 X |
| 3,665,370 | 5/1972 | Hartmann | 339/176 MP X |
| 3,793,609 | 2/1974 | McIver | 339/176 MP X |
| 3,858,958 | 1/1975 | Davies | 361/413 X |
| 3,950,057 | 4/1976 | Calabro | 339/176 MP X |
| 3,977,747 | 8/1976 | Broutous | 339/74 R |
| 4,054,742 | 10/1977 | Bonhomme | 361/413 X |
| 4,196,955 | 4/1980 | Anhalt | 339/74 R |
| 4,261,631 | 4/1981 | Guilchere et al. | 339/75 MP |
| 4,303,294 | 12/1981 | Hamscher et al. | 339/74 R |

OTHER PUBLICATIONS

Franck et al., Microcircuit Module and Connector, IBM Tech. Disc. Bull., V. 13, #7, Dec. 1970, pp. 1786 & 1787.

*Primary Examiner*—R. R. Kucia
*Attorney, Agent, or Firm*—Louis L. Dachs

[57] ABSTRACT

The invention is a circuit board housing for electrically coupling at least one circuit board 14 to a mother board 20 mounted within the housing 10, the circuit board 14 having a plurality of first electrical terminals 90 mounted along an edge portion thereof. The housing has at least one zero insertion force socket 12 wherein a plurality of second electrical terminals 18 are mounted therein. An electrical connector 16 is provided to couple the printed circuit board 14 to the mother board 20. The electrical connector 16 comprises a circuit board support member 26 slideably engageable with the socket 12. A pair of jaws 40*a* and 40*b* are attached to the support member 26 which are adapted to releaseably engage the edge portion of the circuit board 14. The electrical connector further comprises first and second resilient pads 62 and 63 mounted within the jaws. A resilient member 66 is rotatably mounted to the support member 26 moveable from a first position out of engagement with the plurality of second electrical terminals 18 to a second position in engagement therewith. A flexible conductor element 60 is provided having first and second ends incorporating a plurality of first electrical contacts 80 and a middle portion having a plurality of second electrical contacts 84 with the plurality of first and second contacts electrically joined by insulated electrical conductors 82. The first and second ends are wrapped about and joined to the first and second pads 62 and 63, respectively, and the middle portion is wrapped about and joined to the resilient member 66. Thus, when the circuit board 14 is in place and the electrical connector 16 installed in the socket 12 rotation of the resilient member 66 from the first position to the second position makes electrical contact between the plurality of first and second electrical terminals 90 and 18.

4 Claims, 6 Drawing Figures

CIRCUIT BOARD HOUSING WITH ZERO INSERTION FORCE CONNECTOR

TECHNICAL FIELD

The invention relates to the field of housings for connection of circuit boards to mother boards mounted therein and in particular to housings having zero insertion force connectors.

BACKGROUND ART

In recent years, connector technology has not kept pace with the solid state circuit technologies. As the solid state chips have become capable of supporting more and more complicated circuit patterns, the input-output densities, (i.e., the fine signal wires that are necessary to communicate one circuit chip to another usually given in the number of input-output circuits per cubic inch) are also increasing exponentially. As the density of input-output circuits increases, the maintenance and parts damage percentage have gone up and connectors have now become one of the least reliable components within electronic subsystems. For example, the interconnection from chip to chip carrier is accomplished using a 0.002 inch diameter wire and are more reliable than typical connector pins.

To put the problem in perspective; during the vacuum tube era, where considerable power was required for the vacuum tubes, it was common practice to have the complete circuit subassembly serviced by a large cable with a relatively large connector with 1/16-inch diameter pins having to be mated. With the advent of circuit compression through solid state electronics these requirements have now arisen to a point where it is not uncommon for a connector to be required to make 200 to 400 contacts, where the contacts are only 0.030 inch in diameter. With this high density of small pins it is very easy to have one or more of the pins become deflected and/or mate improperly causing poor contact or making the connector unusable. This is why connector failures have become one of the dominate failure modes in avionics equipment.

The principal way of avoiding these pin chrunching connector mating operations is to use what is commonly called a zero insertion force (ZIF) connector. In this type of connector the pins and sockets are mated without any contact of the mating surfaces themselves so that there is very little mating force. With the two halves mated, a latch or cam mechanism is operated to engage all of the contacts and complete the circuit. These ZIF connectors have become very popular and sometimes very exotic.

The one major drawback with prior art designs is that since the connector is usually in the bottom of the housing into which the circuit boards are to be mated, it is very difficult to get to the connector to perform the latching operation.

Front panel operated ZIF connectors have eliminated this problem because the board or module can be inserted from the end of the connector rather than normal to it. This permits the end of the connector to be accessible from the open side of the electronics housing such that when the card or module is mated with the connector it is easy to reach the handle and operate the mating mechanism. Card edge front panel operated ZIF connectors are commercially available at this time, but their size and fabrication technique have not permitted a very high density of connections and they require a very large space for obtaining proper positioning and operation.

A second problem associated with the ZIF connector has to do with the very fine film that develops on contact surfaces from contamination, such as dirt, smoke, etc., which must be wiped off. On any connector it is necessary to have a finite wiping action so that the film is broken and metal surfaces are in intimate contact.

In the high density electronics that have been previously referred to, the design of the backplane or mother board becomes important. As the solid state devices used on the circuit boards have become more complicated and carry many more functions, they also have a large number of connections. This means that relatively small boards now may have as many as four hundred contacts per board that must be mated with the mother board. This high density of traces or terminals have required the use of multi-layer mother boards.

In some applications, particularly for military use, the mother boards have exceeded fifteen layers. The typical connectors used for mating of the subboards perforate the mother board like a picket fence. These piercing type connector terminals require a hole through all layers of the multilayer mother board and each of these holes must be plated through, which requires very stringent quality controls.

Examples of this type of connector are disclosed in the following patents: U.S. Pat. No. 4,196,955, "Zero Insertion Force Connector," by John W. Anhalt; U.S. Pat. No. 3,793,609, "Low Insertion Force Printed Board Connector," by William McIver; U.S. Pat. No. 4,303,294, "Compound Spring Contact," by Wilbur A. Hamshere, Jr., et al; U.S. Pat. No. 4,261,631, "Connector for Printed Circuit Board," by Bernard Guilcher, et al; U.S. Pat. No. 3,977,747, "Zero Insertion Force Connector," by Kamal Shawiky Broutros; and U.S. Pat. No. 3,665,370, "Zero-Insertion Force Connector," by Karl Wilhelm Hartmann. Note that in all of these patents the mother board terminals also act as the locking means for the circuit board and the mother board is pierced by the terminals.

Prior attempts to provide Zero-Insertion Force Connectors which do not pierce the mother board can be found in Applicant A. Morrison's pending application, Ser. No. 521,802 "Front Panel Operated-Zero Insertion Force Housing For Circuit Boards and an Electrical Connector Therefor".

Therefore, it is a primary object of this invention to provide a housing for connecting circuit boards to a mother board wherein the circuit board can be installed with zero insertion force.

It is another object of this invention to increase the allowable electrical terminal contact density for a housing adapted to connect circuit boards with a mother board.

Another object of this invention is to provide a housing for connecting circuit boards to a mother board with zero insertion force and providing front panel locking of the circuit boards therein.

A further object of this invention is to provide a housing for connecting circuit boards to a mother board wherein the mother board is not pierced by electrical terminals; i.e., surface mounted.

A still further object of this subject invention is to provide a housing for connecting circuit boards to a mother board wherein the electrical connector wipes and cleans off the electrical terminals on the mother board, ensuring good electrical contact upon the connection to the mother board terminals.

DISCLOSURE OF INVENTION

The invention is a circuit board housing for electrically coupling at least one circuit board to a mother board mounted within the housing, the circuit board having a plurality of first electrical terminals mounted along an edge portion thereof. The housing has at least one zero insertion force socket wherein a plurality of second electrical terminals are mounted therein.

An electrical connector couples the printed circuit board to the mother board. The electrical connector comprises a circuit board support member slideably engageable with the socket. A pair of jaws are attached to the support member which are adapted to releasably engage the edge portion of the circuit board. The electrical connector further comprises first and second resilient pads mounted within the jaws. A resilient member is rotatably mounted to the support member moveable from a first position out of engagement with the plurality of second electrical terminals to a second position in engagement therewith.

A flexible conductor means is provided having first and second ends incorporating a plurality of first electrical contacts and a middle portion having a plurality of second electrical contacts with the first and second contacts electrically joined by insulated electrical conductors. The first and second ends are wrapped about and joined to the first and second pads respectively and the middle portion is wrapped about and joined to the resilient member. Thus, when the circuit board is in place and the electrical connector installed in the socket, rotation of the resilient member from the first position to the second position causes electrical contact to be made between the plurality of first and second electrical terminals.

The novel features which are believed to be characteristic of the invention both as to its organization and method of operation, together with further objects and advantages thereof, will be better understood from the following description and connection with the accompanying drawings which a presently preferred embodiment of the invention is illustrated by way of example. It is to be expressly understood, however, that the drawings are for purposes of illustration and description only, and are not intended as a definition of the limits of the invention.

BRIEF DESCRIPTION OF DRAWINGS

Illustrated in FIG. 1 is a partial perspective view of the housing with a circuit board partially withdrawn.

Illustrated in FIG. 2 is a cross-sectional view of the housing shown in FIG. 1 along the line 2—2.

Figure 2:
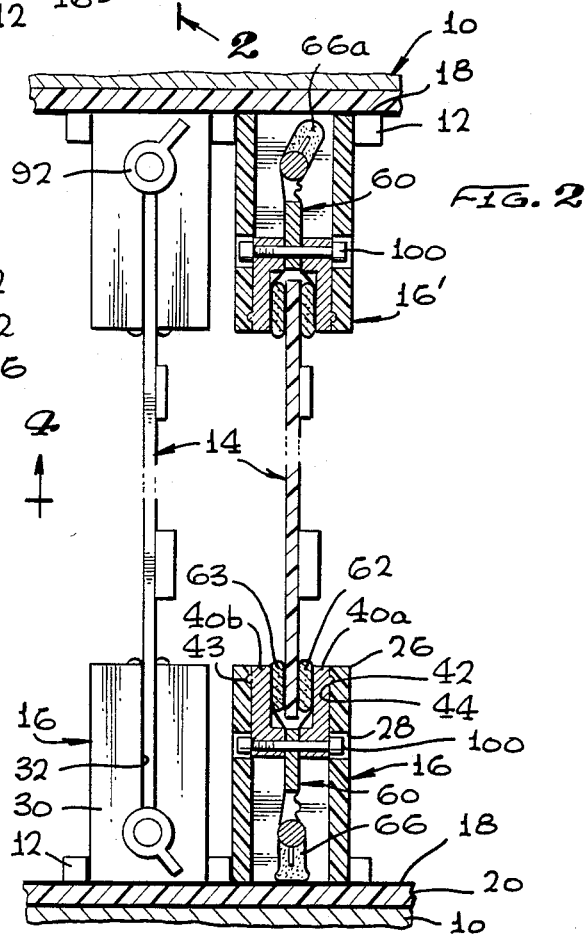
Figure 3:
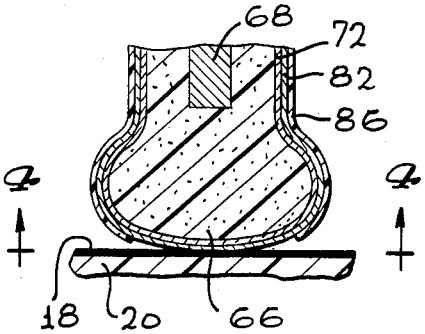

Illustrated in FIG. 3 is an enlarged view of a portion of the connector shown in FIG. 2.

Figure 4:
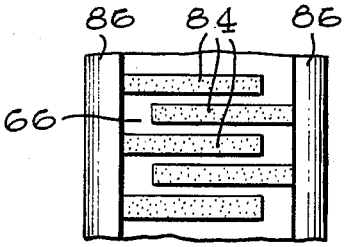

Illustrated in FIG. 4 is a partial view of the connector shown in FIG. 3 along the line 4—4.

Figure 1:
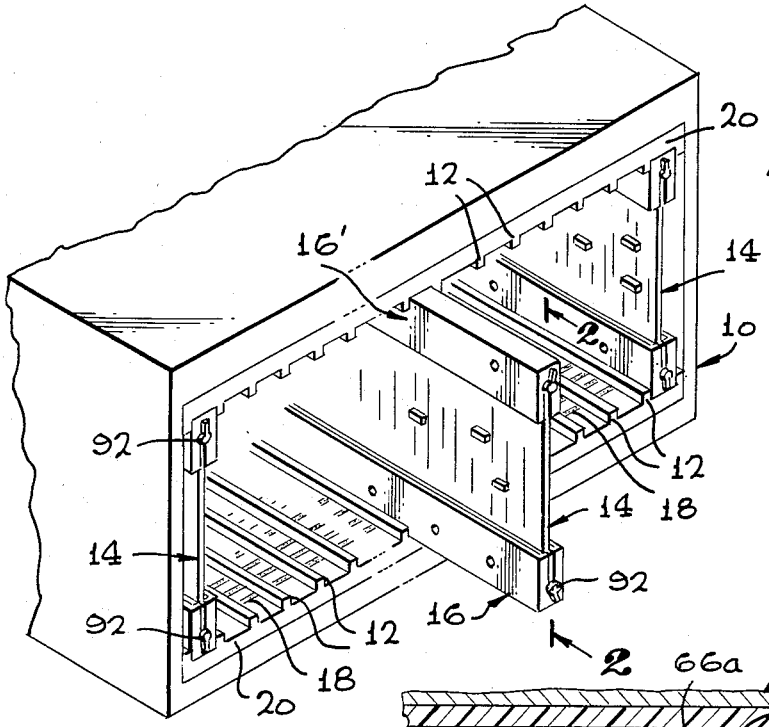
Figures 5, 6:
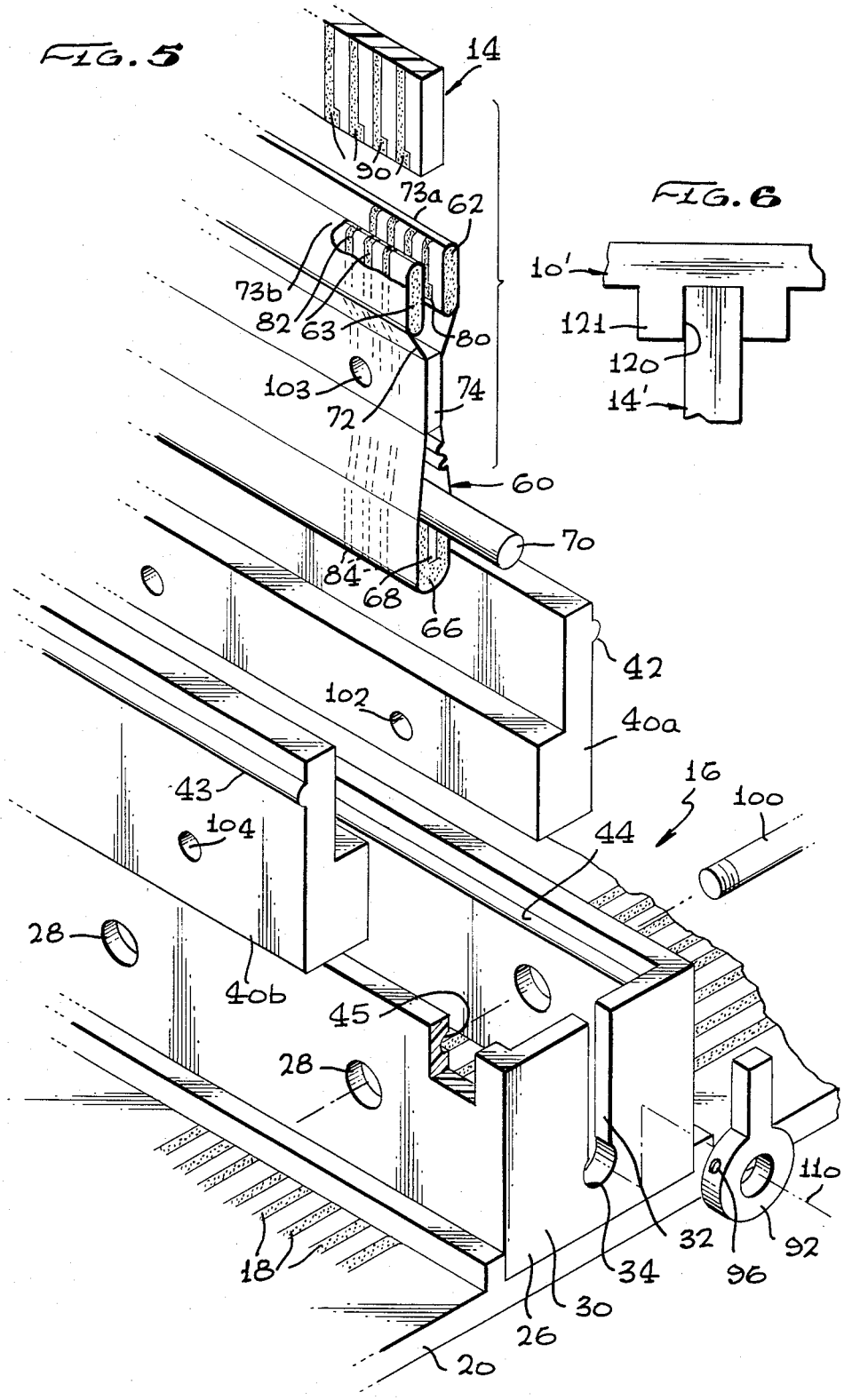

Illustrated in FIG. 5 is an exploded perspective view of the electrical connector shown in FIGS. 1 and 2.

Illustrated in FIG. 6 is a partial view of a housing showing an alternate guide means for the printed circuit board.

BEST MODE FOR CARRYING OUT THE INVENTION

Referring to FIGS. 1 and 2, it can be seen that the housing, generally designated by numeral 10, comprises a plurality of zero insertion force sockets 12 in which are mounted a plurality of circuit boards 14 by means of electrical connectors 16 and 16' at each end. The electrical connectors 16 electrically couple the circuit boards to the plurality of electrical traces or terminals 18 mounted on the mother board 20.

Still referring to FIGS. 1 and 2 and additionally to FIGS. 3–5, it can be seen that the electrical connectors 16 comprise a hollow support member 26, perferrably made out of a semi-resilient plastic material. The member 26 incorporates a plurality of holes 28 along its length and at its front end 30 a slot 32 terminating in an aperture 34.

Mounted within the member 26 is a clamping means omprising a pair of jaws 40*a* and 40*b*. The jaws 40*a* and 40*b* incorporate a protrusion 42, and 43, respectively, which are adapted to mate with grooves 44 and 45, respectively, in the member 26. The jaws 40*a* and 40*b* are installed within the member 26 by spreading apart the walls of the member 26 and become locked in place when the protrusions 42 and 43 engage the grooves 44 and 45, respectively.

Mounted within the member 26 and jaws 40*a* and 40*b* is a flexible connector element, generally designated by numeral 60. The element 60 comprises a pair of resilient pads 62 and 63 adapted to be mounted within the jaws 40*a* and 40*b*, respectively. The opposite end terminates in a resilient member 66 which is bonded to a reinforcing plate 68. The plate 68 in turn is coupled to a shaft 70. Wrapped about the resilient member 66 and the resilient pads 62 and 63 is a flexible insulation layer 72. The ends 73*a* and 73*b* of layer 72 are wrapped round and bonded to the resilient pads 62 and 63, respectively, and the middle portion is wrapped about and bonded to the resilient member 66. The resilient layer 72 is also joined to a mounting plate 74, located between pads 62 and 63 and resilient member 66.

Mounted on the ends 73*a* and 73*b* of the insulation layer 72 are a plurality of first electrical contacts 80. The first electrical contacts 80 are joined to conductors 82 which extend along the flexible insulation layer 72 and couple to a plurality of second electrical contacts 84 mounted on the middle portion of layer 72 at the center of the resilient member 66. A flexible insulating cover 86 is bonded over and about the conductors 82. Typically, contacts 80 and 84, and conductors 82 are simultaneously electrodeposited on the layer 72.

The circuit board 14 has a plurality of electrical terminals 90 mounted along the edge portion (best seen in FIG. 5) which mate with the contacts 80 when the circuit board is installed within the jaws 40*a* and 40*b*. With the circuit board 14 installed in the jaws 40*a* and 40*b*, the jaws and element 60 can be installed within the member 26 as previously described. The member 60 as well as the circuit board 14 are further clamped by means of fasteners 100 (only one of which is shown). Fastener 100 when installed via hole 28 in member 26 extends through aperature 102 in the jaw 40*a*, hole 103 in element 60 and, finally into the threaded hole 104 in member 40*b*. When so installed, the shaft 70 extends out of the aperture 34. Thus, a knob 92 can be clamped thereon by means of a set screw 96.

With each end of the circuit board 14 coupled to an electrical connector 16 the assembly thus formed can be installed in socket 12. Note that the resilient member 66 is placed in the first position indicated by numeral 66*a* (FIG. 2) when the electrical connector 16 is installed in the socket 12 such that the electrical contacts 84 make no engagement with the terminals 18 mounted on the mother board 20.

Referring particularly to FIGS. 2, 3, and 5, it can be seen that after insertion the shaft 70 is rotated to cause the resilient member 66 found thereto to move to a second position wherein the contacts 84 engage the terminals 18 on the mother board 20. Since the distance from the axis of rotation 110 of the resilient member 66 to the mother board 20 is less than the length of the member 66 a load is applied between the contacts 84 and terminals 18 and a considerable wiping action is obtained.

Although the circuit board is shown clamped on either end by an electrical connector there may be applications where only one connector is required. In such cases the guide means as illustrated in FIG. 6 can be used for positioning the opposite end. Here the circuit board, indicated by numeral 14', rides in a groove 120 in guide member 121 attached to the housing 10'. But in general, due to the fact that circuit boards have a high density of components mounted thereon, a connector 16 at either end of the circuit board will normally be required.

While the circuit board housing with zero insertion force connector has been described with reference to a particular embodiment, it should be understood that the embodiment is merely illustrative as there are numerous variations and modifications which may be made by those skilled in the art. Thus, the invention is to be construed as being limited only by the spirit and scope of the appended claims.

INDUSTRIAL APPLICABILITY

The housing has applicability on electronic equipment, and in particular, those using printed circuit boards.

We claim:

1. A circuit board housing for electrically coupling at least one circuit board to a mother board mounted within said housing, said circuit board having a plurality of first electrical terminals mounted along at least one edge portion thereof, the housing comprising:

said housing having at least one zero insertion force socket, said at least one socket having a plurality of second electrical terminals mounted therein;

an electrical connector comprising:

a circuit board support member slideably engageable with at least one said socket, said support member having clamping means mounted thereto adapted to releaseably engage said edge portion of said circuit board;

a resilient member rotatably mounted in said support member having a plurality of first electrical contacts mounted thereon, said resilient member rotatable from a first position wherein said plurality of first electrical contacts are out of engagement with said plurality of second electrical terminals to a second position wherein said plurality of electrical contacts are in engagement therewith;

flexible conductor means electrically connecting said plurality of said first electrical terminals on said circuit board to said plurality of electrical contacts on said resilient member.

2. The housing as set forth in claim 1 wherein the distance between the axis of rotation of said resilient member and said plurality of second terminals is such that a substantial deformation of said resilient member occurs when said resilient member is rotated from said first position to said second position causing a significant wiping action between said plurality of first contacts and said plurality of second electrical terminals.

3. The housing as set forth in claim 2 wherein said resilient member is joined to a reinforcing member which is rotatably mounted in said support member; and handle means coupled to said reinforcing member providing a means to rotate said first resilient.

4. A circuit board housing as set forth in claim 3 including:

said flexible conductor means comprising:

first and second resilient pads having opposed principle surfaces mounted within said clamping means;

a flexible sheet having first and second ends, said first and second ends joined to said opposed principle surface of said first and second resilient pads and wrapped therearound, and further having a middle portion wrapped about and joined to said resilient member;

a plurality of second electrical contacts mounted to the first and second electrical conductors mounted to said first and second end portions of said flexible sheet and adapted to engage said plurality of first electrical terminals on said circuit board when said circuit board is installed in said clamping means;

a plurality of insulated electrical conductors mounted on said flexible sheet electrically coupling said first and second connectors together; and said first electrical contacts mounted on said flexible sheet.

* * * * *